United States Patent [19]

Jerden

[11] 4,383,480

[45] May 17, 1983

[54] CAN CRIMPING AND FOLDING DEVICE

[76] Inventor: Ody K. Jerden, 5000 Edinburgh #102, Tyler, Tex. 75703

[21] Appl. No.: 305,133

[22] Filed: Sep. 24, 1981

[51] Int. Cl.[3] ..... B30B 1/04; B30B 9/32

[52] U.S. Cl. ..... 100/98 R; 100/137; 100/233; 100/295; 100/902

[58] Field of Search ..... 100/902, 233, 295, 98 R, 100/137

[56] References Cited

U.S. PATENT DOCUMENTS

| | | | |
|---|---|---|---|
| 2,466,907 | 4/1949 | Nadolny et al. | 100/902 |
| 2,603,270 | 7/1952 | Voigt et al. | 100/902 |
| 2,905,079 | 9/1959 | Brock | 100/902 |
| 3,667,386 | 6/1972 | Workman | 100/902 |
| 3,776,129 | 12/1973 | Carlson | 100/902 |
| 3,853,054 | 12/1974 | Jacobsen | 100/902 |
| 3,948,164 | 4/1976 | Pobuda | 100/902 |
| 4,058,054 | 11/1977 | Markman | 100/902 |

*Primary Examiner*—Billy J. Wilhite

*Attorney, Agent, or Firm*—Charles Gunter

[57] ABSTRACT

A can crimping and folding device is shown which has a base plate having a crimping area and a folding area. The areas are adapted to sequentially receive a can, the length of which is transversely aligned with the longitudinal axis of the base plate. A pivotable handle is attached at one end of the base plate and rotates toward and away from the base plate. The handle has a two-position can crimping portion adapted to meet the base crimping area and a can folding portion adapted to meet the base folding area. The can folding portion of the handle has double concave depressions therein to increase the mechanical advantage of the device.

7 Claims, 3 Drawing Figures

CAN CRIMPING AND FOLDING DEVICE

BACKGROUND OF THE INVENTION

The present invention relates generally to the field of can flattening devices and specifically to a can flattening device which sequentially crimps and folds cans and which is able to accommodate cans of varying lengths.

Increased recycling of used aluminum beverage cans in recent years has made can collection a profitable pastime for many people. A mechanical device for flattening collected cans would be advantageous since a flattened can will occupy one third or less of the total volume of the unflattened can.

Various can flattening, crushing, and folding devices are shown in the prior art. U.S. Pat. No. 2,466,907 to Nadolny shows a can crusher, apparently for soup cans and the like, which crushes the can in one step. U.S. Pat. No. 2,603,270 to Voigt shows a can crusher which uses a complicated power arm arrangement to achieve a mechanical advantage in a one step crushing operation. U.S. Pat. No. 2,905,079 to Brock shows a two step crushing operation, the first step of which punctures the opposing ends of the can. There is no crimping station and the can is not first crimped prior to folding. U.S. Pat. No. 3,853,054 to Jacobsen shows a two step folder which has a surface with teeth for puncturing and flattening the can and another surface with ridges for folding the can. A central lever is pivotally arranged between the two working surfaces. The can is first flattened, then folded at an angle, then flattened again. U.S. Pat. No. 3,948,164 to Pobuda shows a device with a curved upper surface and cutting blades which pierce the can during the flattening operation. The device does not employ sequential crimping and folding.

U.S. Pat. No. 4,058,054 to Markman shows a can folder and flattener having a base and pivotal lever, the lever having a flattening block and a reversible folding block to accommodate cans of different lengths. A pin is provided to position the can during folding. The flattening anvil of the Markman device is a flat surface.

Prior devices have tended to be large and bulky and not well adapted for use in locations in the home, such as on a kitchen counter. Certain of the prior designs have required massive force for operation since the can was crushed in a single step. The operation of such devices could, on occasion, be hazardous to the operator and, because of the force required, was beyond the physical capacity of some persons. Other prior designs were prohibitively expensive to manufacture and overly complicated. Certain of the prior designs had to be fastened down to work.

A need exists therefore, for a can flattening device which is simple in design and inexpensive to manufacture, which is of a convenient size to be used and stored in the home, and which can be operated with a minimum of physical effort.

SUMMARY OF THE INVENTION

The can crimping and folding device of the present invention has a base plate having a crimping area and a folding area. The crimping and folding areas are adapted to sequentially receive a can, the length of which is transversely aligned with the longitudinal axis of the base plate. A pivotable handle is attached at one end of the base plate for rotation toward and away from the base plate. The handle has an elongated, two position, can crimping portion adapted to meet the base crimping area and a can folding portion adapted to meet the base folding area. The can folding portion of the handle has double concave depressions therein.

In the preferred embodiment, two or more spikes are located on the base folding area with one of the spikes located beneath each of the concave depressions in the can folding portion when the can folding portion meets the can folding area. A fixed bar transversely aligned to the longitudinal axis of the base plate serves to locate and retain the can in the base folding area. The double concave depressions in the can folding portion are preferably separated by a ridge which is substantially flush with the remaining surface of the can folding portion. A hand grip is attached to the pivotable handle opposite the can crimping portion and forms an arch with respect to the pivotable handle for receiving the user's hand.

Additional objects, features and advantages will be apparent in the following description.

DETAILED DESCRIPTION OF THE INVENTION

Figure 1:
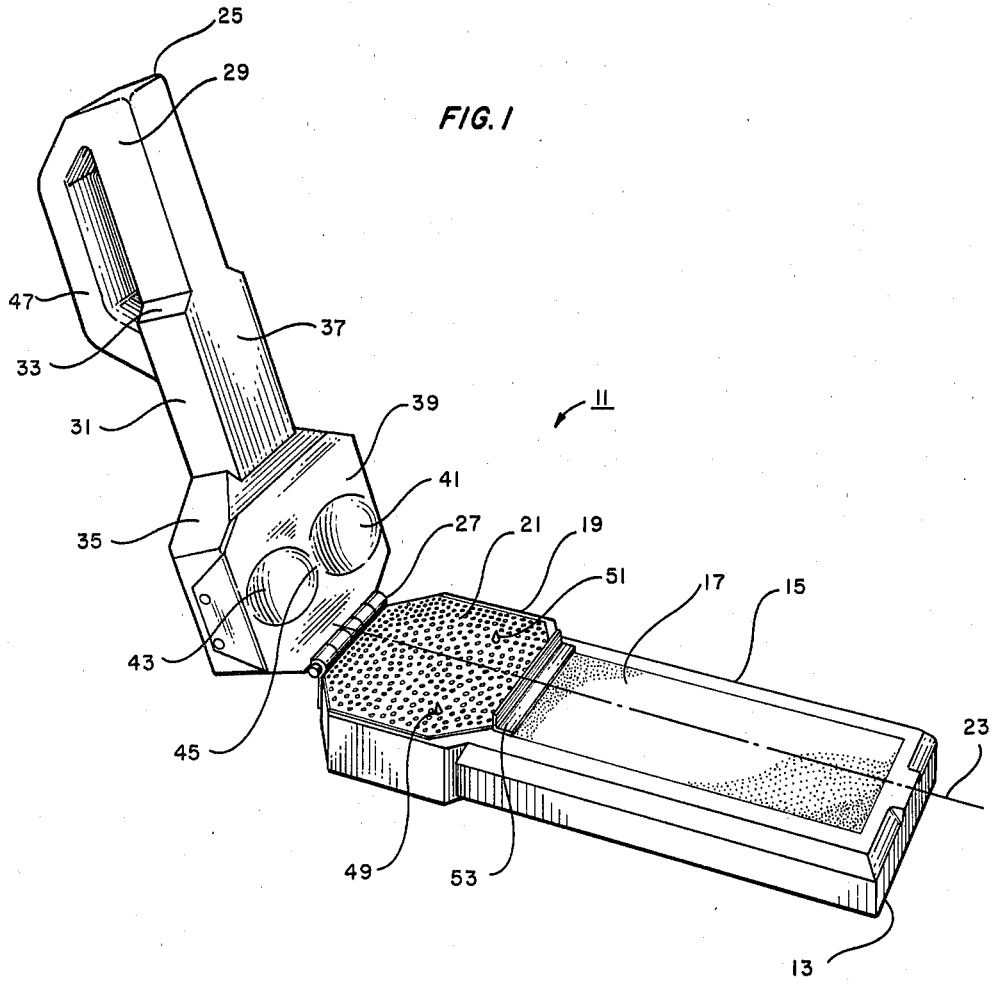
FIG. 1 is a perspective view of the device of the invention in the can-receiving position.

Turning now to FIG. 1, there is shown a can crimping and folding device of the invention designated generally as 11. The can crimping and folding device includes a base plate 13 comprising an elongated generally rectangular part 15 having a crimping area 17 on the upper surface thereof and terminating in a slightly larger octagon shaped portion 19 having a folding area 21 on the upper surface thereof. The crimping area 17 and folding area 21 are conveniently sized and adapted to sequentially receive a can, such as an aluminum beverage can, the length of which is transversely aligned with the longitudinal axis 23 of the base plate 13.

Figure 3:
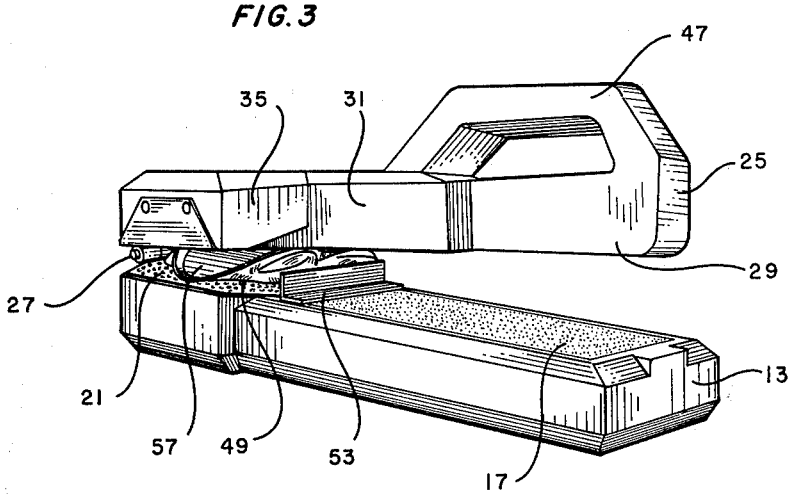
FIG. 3 is a perspective view of the device similar to FIG. 2 but showing a can in the can folding area.

A pivotable handle 25 is attached at the end of the base plate 13 nearest folding area 21, as by a hinge 27, for rotation toward and away from the base plate 13. As shown in FIG. 3, hinge 27 is selectively positioned to space handle 25 apart slightly from base plate 13 when handle 25 is moved to a position generally parallel to base plate 13. Handle 25 has a narrow, generally rectangular outer extent 29 joined to a generally rectangular inner extent 31 of slightly greater width by upset areas 33. The lower surface 37 of outer extent 29 and inner extent 31 together comprise an elongated, two-position, can crimping portion adapted to meet the base crimping area 17 as will be more fully described later. Inner extent 31 in turn is joined to an octagon shaped upper member 35 the dimensions of which conveniently correspond to those of octagon shaped part 19 of base plate 13. The lower surface 39 of upper member 35 has double, generally eliptical concave depressions 41, 43 formed therein which are separated by a ridge 45 which is substantially flush with the remaining surface 39. Depressions 41, 43 and ridge 45 form a butterfly-shaped image in lower surface 39.

A hand grip 47 is attached to pivotable handle 25 opposite the can crimping portion 37 at the end of handle 25 opposite upper member 35. Hand grip 47 forms an arch with respect to the pivotable handle 25 for receiving the user's hand.

The lower surface 39, double concave depressions 41, 43, and ridge 45, together comprise a can folding portion adapted to meet the base folding area 21.

The base folding area 21 has at least two spikes 49, 51 which protrude upwardly from area 21 normal to the plane of area 21 which serve as puncture means on the base folding area for puncturing each end of a can being folded. A spike 49, 51 is located beneath each of the double concave depressions 41, 43 in the can folding portion 39 when that portion 39 meets the can folding area 21. A fixed bar 53 can be provided in transverse alignment to the longitudinal axis 23 of the base plate between the base folding area 21 and the base crimping area 17 to serve as a retaining means for locating and retaining a can on the base plate folding area 21. The base plate folding area 21 and the crimping area 17 can also be provided with a rough textured surface, such as sand paper, in order to assist in securing the can and to prevent slippage.

Figure 2:
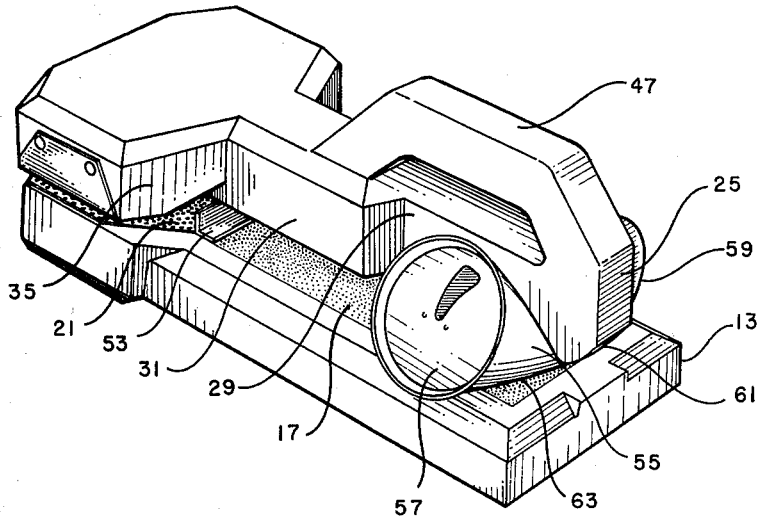
FIG. 2 is a perspective view similar to FIG. 1 but showing a can in the can crimping area.

The operation of the can crimping and folding device of the invention will now be described. Turning to FIG. 2, an aluminum beverage can 55 having a top end 57 and a bottom end 59 is shown in place on the first stage of the crimping area 17. The can is placed on the rough textured surface of the crimping area 17 with the handle 25 in the open, can-receiving position shown in FIG. 1 and the handle is rotated toward the base plate 13 to the closed, can-crimping position shown in FIG. 2. The outer extent 29 of the handle is used to crimp a twelve ounce beverage can and, as shown in FIG. 2, flattens the mid portion 61 of the can and turns the top and bottom ends 57, 59 of the can in toward the mid portion 61. The inner extent 31 of handle 25 can be used in a similar fashion to crimp cans of greater length such as the sixteen ounce aluminum beverage cans.

After selecting the appropriate can crimping stage and crimping the can as shown in FIG. 2, the handle 25 is again raised to the open position shown in FIG. 1 and the crimped can is placed on the can folding area 21 of base plate 13 with the uncrimped side 63 contacting the folding area 21. The can is again transversely aligned to the longitudinal axis 23 of base plate 13 and spikes 49, 51 are located under the portions of can 55 on either side of mid portion 61. The pivotable handle 25 is then lowered to the can folding position shown in FIG. 3 and double concave depressions 41, 43 contact the edges of the crimped can, thereby folding and flattening the can. When the folding process is complete, the can top and bottom ends 57, 59 will be folded flat on the crimped side of the can and the ridge 45 of the folding portion of handle 25 will rest between or on the junction of the folded ends 57, 59.

An invention has been provided with significant advantages. The can folding device of the invention is simple in design and economical to manufacture. The device is totally portable and does not have to be fastened in place to work. The device has sequential crimping stations to accommodate cans of varying length. By placing a second can on the crimping area while a first can is being folded on the folding area, processing time can be increased. The hand grip protects the user's fingers while allowing the overall length of the device to be shortened. The double concave depressions and ridge in the can folding portion of the handle combine to maximize the mechanical advantage of the device, thereby requiring a minimum of physical exertion during operation. The puncture means located in the folding area allow trapped air to escape from the ends of the can being folded and further reduce the effort required for operation. The device can be conveniently manufactured of a size which will fit on a kitchen counter top and is pleasing in appearance. Cans flattened with the present device are reduced to approximately one third of their former volume, thereby facilitating storage and handling of used cans.

While the invention has been shown in only one of its forms, it will be appreciated that it is not thus limited but is susceptible to various changes and modifications without departing from the spirit thereof.

I claim:

1. A can crimping and folding device, comprising:

a base plate having a crimping area and a folding area, said areas being adapted to sequentially receive a can, the length of which is transversely aligned with the longitudinal axis of said base plate;

a pivotable handle attached at one end of said base plate for rotation toward and away from said base plate, said handle having an elongated, two-position, can crimping portion adapted to meet said base crimping area and a can folding portion adapted to meet said base folding area; and said can folding portion of said handle having double concave depressions therein.

2. A can crimping and folding device, comprising:

a base plate having a crimping area and a folding area, said areas being adapted to sequentially receive a can, the length of which is transversely aligned with the longitudinal axis of said base plate;

a pivotable handle attached at one end of said base plate for rotation toward and away from said base plate, said handle having an elongated, two-position, can crimping portion adapted to meet said base crimping area and a can folding portion adapted to meet said base folding area, said can folding portion of said handle having double concave depressions therein;

puncture means on said base folding area for puncturing each end of a can being folded; and retaining means between said base folding area and said base crimping area for locating and retaining a can on said base folding area.

3. The can crimping and folding device of claim 2, wherein said puncture means is at least two spikes, one of which is located beneath each of said concave depressions in said can folding portion when said portion meets said can folding area.

4. The can crimping and folding device of claim 2, wherein said retaining means is a fixed bar transversely aligned to the longitudinal axis of said base plate.

5. The can crimping and folding device of claim 2, wherein said double concave depressions in said can folding portion are separated by a ridge, said ridge being substantially flush with the remaining surface of said can folding portion.

6. The can crimping and folding device of claim 2, wherein said can folding area has a rough textured surface.

7. The can crimping and folding device of claim 2, further comprising:

a hand grip attached to said pivotable handle opposite said can crimping portion, said hand grip forming an arch with respect to said pivotable handle for receiving the user's hand.

* * * * *